US010344236B2

(12) United States Patent
Ocampo Barrera et al.

(10) Patent No.: US 10,344,236 B2
(45) Date of Patent: Jul. 9, 2019

(54) PROCESS OF PREPARING FUEL IN WATER EMULSIONS FROM OIL REFINING RESIDUES

(71) Applicant: INSTITUTO MEXICANO DEL PETRÓLEO, Mexico City (MX)

(72) Inventors: René Ocampo Barrera, México (MX); Martha García Espitia, México (MX); Andrés Alberto Ceballos Serena, México (MX)

(73) Assignee: INSTITUTO MEXICANO DEL PETRÓLEO, Mexico City (MX)

( * ) Notice: Subject to any disclaimer, the term of this patent is extended or adjusted under 35 U.S.C. 154(b) by 200 days.

(21) Appl. No.: 14/964,366

(22) Filed: Dec. 9, 2015

(65) Prior Publication Data

US 2016/0177206 A1 Jun. 23, 2016

(30) Foreign Application Priority Data

Dec. 17, 2014 (MX) ..... A/2014/015589

(51) Int. Cl.
*C10L 1/32* (2006.01)

(52) U.S. Cl.
CPC ..... *C10L 1/328* (2013.01); *C10L 2200/0438* (2013.01); *C10L 2250/082* (2013.01);
(Continued)

(58) Field of Classification Search
CPC ..... C10L 1/328
See application file for complete search history.

(56) References Cited

U.S. PATENT DOCUMENTS 3,859,238 A * 1/1975 Kremser ..... C08L 23/10 524/59
5,000,757 A * 3/1991 Puttock ..... B01F 3/088 431/4

FOREIGN PATENT DOCUMENTS

MX PA01003592 A 8/2007
MX PA06002412 A 8/2007

* cited by examiner

*Primary Examiner* — Ellen M McAvoy
*Assistant Examiner* — Ming Cheung Po
(74) *Attorney, Agent, or Firm* — Casimir Jones, S.C.; Anne M. Reynolds

(57) ABSTRACT

The present invention relates to a process for preparing fuel-in-water emulsions from oil refining residues, in both continuously or in batches, by adding an emulsifying agent to disperse the residual oil in water and facilitate its transportation. This process does not require the use of chemical substances like stabilizers or diluents for its preparation. The vacuum residue is not limited to specific characteristics and the water used, can be distilled, tap water or saltwater (seawater). The process requires low concentration of a non-ionic surfactant; and the emulsions obtained have proportions from 70 to 90% by weight of refining residues, 10 to 30% by weight of water and from 0.1 to 1% by weight of surfactant.

The fuel-in-water emulsion is produced from oil refining residues, such as residues of atmospheric and vacuum distillation, heavy fuel oils and similar, and it is formed from 70 to 90% by weight of refining residues, 10 to 30% by weight of water and from 0.1 to 1% by weight of non-ionic surfactant. This fuel is efficient to its burned, because the fuel oil droplets have the best size to be completely burned into the flame, which has a favorable effect to reduce the unburned particle emissions. In addition, the emulsified fuel
(Continued)

remains stable for an enough period for its storage and subsequent injection to the combustion equipment.

11 Claims, 1 Drawing Sheet

(52) U.S. Cl.
CPC ..... *C10L 2290/06* (2013.01); *C10L 2290/24* (2013.01); *C10L 2290/60* (2013.01)

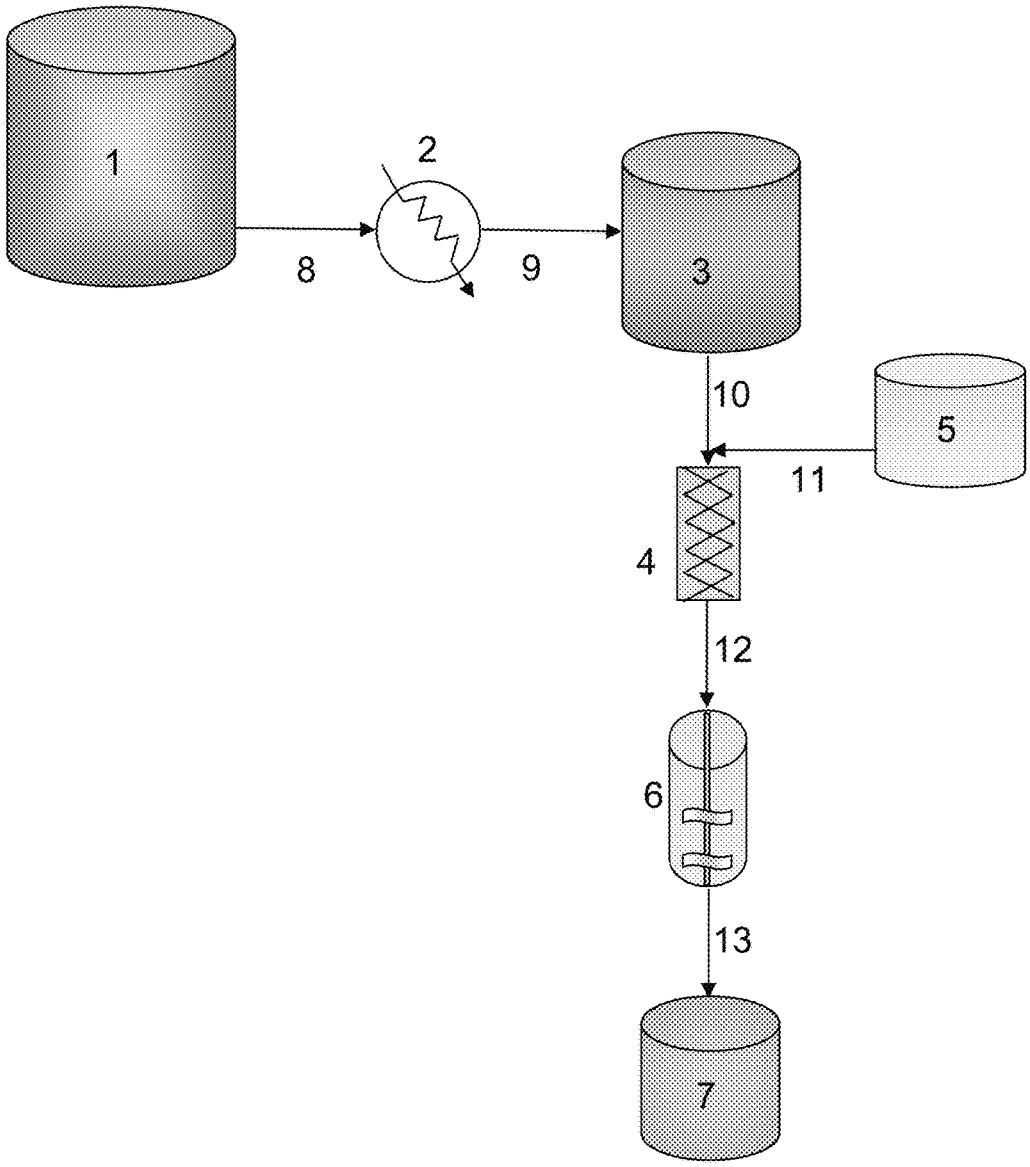
1
2
8
9
3
10
5
11
4
12
6
13
7

PROCESS OF PREPARING FUEL IN WATER EMULSIONS FROM OIL REFINING RESIDUES

CROSS-REFERENCE TO RELATED APPLICATION(S)

This claims priority to Mexican Patent Application No. MX/a/2014/015589, filed on Dec. 17, 2014, the entire contents of which are fully incorporated herein by reference.

FIELD OF THE INVENTION

The present invention relates to a process for preparing fuel-in-water emulsions from oil refining residues, in both continuously or in batches, by adding an emulsifying agent to disperse the residual oil in water and facilitate its transportation. This process does not require the use of chemical substances like stabilizers or diluents for its preparation. The vacuum residue is not limited to specific characteristics and the water used, can be distilled, tap water or saltwater (seawater). The process requires low concentration of a non-ionic surfactant; and the emulsions obtained have proportions from 70 to 90% by weight of refining residues, 10 to 30% by weight of water and from 0.1 to 1% by weight of surfactant. Furthermore, the invention is also related to fuels for industrial applications such as electricity generation from thermoelectric plants; because, the resulting fuel can be used in industrial combustion equipment such as boilers, fired heaters, process furnaces and similar equipment. Fuel that is produced from oil petroleum residues, which result from the refining processes such as vacuum and atmospheric distillations, heavy fuel oils and similar.

BACKGROUND OF THE INVENTION

Nowadays, some thermoelectric plants use heavy fuel oil as fuel, which is produced diluting the vacuum residue with lighter refining oil products as diesel, kerosene and other cyclic oils to reduce its viscosity and facilitate its transportation. The use of such diluents make expensive the resulting fuel.

Moreover, the petroleum production in Mexico tends to increase in heavy crude oil extraction compared to light crude oil, leading to petroleum industry to process heavier crude oils, and improve at the same time, the efficiency of the refining processes; consequently, the oil refining residues produced shows higher values than before of viscosity, sulphur, sodium and vanadium; causing that the heavy fuel oil used by industry in general, and by thermoelectric plants in particular, to be more viscous and difficult to burn.

One way to reduce the viscosity of heavy hydrocarbons is emulsify them in water, the resulting fuel is easier than the original one to be transported for burning in the combustion equipment. The preparation of emulsions involves the dispersion of droplets of one liquid in another immiscible liquid. In the case of the vacuum residue, which is a complex heterogeneous system due to the amount and structure of its compounds and that is a hydrophobic material, can be dispersed in water—the aqueous medium or continuous phase- to form an emulsion of oil in water type; that avoids the addition of diluents which are higher-value products.

Ideas have been raised up and emulsified fuels has been developed from natural materials, such as bituminous material from the Orinoco riverbank, which was used to produce the so-called "Orimulsion". These fuels does not come from industrially processed materials; thus, the ingredients, proportions, temperature and operating conditions differ substantially from those of this invention.

However, there is another emulsified fuel obtained from processed materials, whose patent (MX/PA/01003592), relates to continuous and batch processes to prepare it from vacuum residue of the oil refining. The procedure is limited in both continuous and batch processes, because it requires the use of a chemical substance as a stabilizer additionally of a surfactant to prepare the emulsion, and claims a vacuum residue and distilled water with specific characteristics. In that patent, the weight proportions for each component of emulsified fuel are as follows: 69 to 75% by weight of refining residues; 23.9 to 29.9% by weight of water; 0.5 to 1.5% by weight of surfactant and 0.05 to 0.15% by weight of stabilizer.

There also exists another patent (MX/A/06002412) in which the authors have improved the procedure contained in the MX/PA/01003592 patent referred above. Now, this patent, MX/A/06002412, comprises a continuous and in batch procedures for the preparation of emulsified fuels coming from processed materials of the vacuum unit of the oil refining; this procedure is limited in both continuous and batch processes, because it requires the use of a diluent during the preparation of the emulsion, and also claims a vacuum residue and water with specific characteristics. In that patent, the weight proportions for each component of emulsified fuel are as follows: 65 to 71% by weight of refining residues, 2 to 3% by weight of diluent respect to the residue, 27 to 33% by weight of water and 1 to 3% by weight of surfactant. It should also be noted that in this patent, no substance to stabilize the emulsion is used, but a diluent is required and the surfactant values used are higher than that in the MX/PA/01003592 patent referred initially.

In conclusion, it is important to establish that the main object of our invention is to provide to both oil and industrial sectors of a process for preparing a fuel-in-water emulsion in both continuous or in batch process. Process characterized because it does not require the use of chemical substances as stabilizers or diluents for its preparation, the vacuum residue is not limited to specific characteristics, and the water used can be of three types: distilled, tap water or salt water (seawater), and requires low concentration of a nonionic surfactant from 0.1 to 1% by weight. The emulsions obtained have proportions from 70 to 90% by weight of refining residues, 10 to 30% by weight of water and from 0.1 to 1% by weight of surfactant.

A further object of our invention is the emulsified fuel in water, produced from residues of oil refining processes, such as residues of atmospheric and vacuum distillation, heavy fuel oils and similar, and this fuel can be used in industrial combustion equipment such as boilers, fired heaters, process furnaces and similar equipment. This fuel is efficient to its burned; because the fuel oil droplets have the best size to be completely burned into the flame, which has a favorable effect to reduce the unburned particle emissions In addition, the emulsified fuel remains stable for an enough period for its storage and subsequent injection to the combustion equipment.

These and other objects of the present invention are described in more detail in the following chapters.

BRIEF DESCRIPTION OF THE INVENTION DRAWINGS

FIG. 1, is a flow chart that shows the continuous process approach of the present invention.

The best-known method to prepare emulsified fuels in water from petroleum residuals, object of the present invention, is presented in the section of detailed description of the invention.

DETAILED DESCRIPTION OF THE INVENTION

From a more detailed viewpoint, the present invention relates to a process for preparing an emulsified fuel in both continuously or in batches; and the resulting fuel emulsified in water obtained with this procedure.

The process to prepare an emulsified fuel in water in a continuous way, object of the present invention is carried out according to FIG. 1 and comprises the following steps:

I. Conditioning of the Vacuum Residue. Conditioning through a heat exchanger (2), the temperature of the vacuum residue coming from a container (1), which may be the vacuum distillation tower or another vessel with a residual oils, whose temperature is approximately 480° C. if coming directly from the vacuum distillation tower. The vacuum residue passed through a pipe represented by line (8), from the container (1) to the heat exchanger (2), where its temperature is adjusted to approximately 110° C. The vacuum residue conditioned passes through a pipe represented by line (9), from the heat exchanger (2) to a recipient of temporary storage (3), in which it is kept at a temperature about 110° C.

II. Preliminary Mixed. The vacuum residue is mixed with water and non-ionic surfactant in a static mixer (4), the vacuum residue comes from the temporary storage container (3) and goes to the static mixer (4) through a pipe represented by the line (10), at a temperature between 70 and 110° C. depending on the viscosity of the vacuum residue; since the viscosity of the vacuum residue depends of both the characteristics of the crude oil from which it is originated and the severity of the refining process. The vacuum residue conditioning and the handling temperature of the vacuum residue during the process provide the characteristic that the vacuum residue can be of any type and it is not limited to certain specifications; at the same time, not diluents are required to handle because it remains fluid. Meanwhile, the surfactant-water mixture previously homogenized and stored in a container (5), where the temperature is kept between 55 and 60° C., is dosed to the static mixer (4) at a temperature between 55 and 60° C., through a pipe represented by line (11).

III. Emulsion Formation. The preliminary mixture that leaves the static mixer (4) is fed through a pipe represented by line (12) to the dynamic mixer (6), at a temperature between 60 and 80° C., where the emulsion is formed. Then the emulsion passes through a pipe represented by line (13), to a container (7) for emulsion storage. The shear stress imposes to the vacuum residue and its interaction with the water and the surfactant when passages though the interior of the dynamic mixer, together with the temperature and characteristics of the surfactant used, produces an emulsion with particle size that does not significantly change with respect to time, namely it remains stable. Because of that, it does not require additional stabilizers for its preservation. Additionally, the type of surfactant and temperature conditions used during the preparation procedure confer to the process the characteristic to use distilled water, tap water or saltwater (seawater) and low concentration of surfactant. With this process, the emulsified fuel is prepared in a continuous way, and have proportions from 70 to 90% by weight of refining residues, 10 to 30% by weight of water and from 0.1 to 1% by weight of surfactant.

Another way of the novel procedure of this invention comprises a batch process, which consist of the following steps:

I. Weigh the Components of the Emulsion: Weigh the vacuum residue, the non-ionic surfactant and the water (distilled, tap water or saltwater) separately and put each component in a container previously weighted.

II. Heat the Vacuum Residue: Heat the vacuum residue at 110° C. approximately and homogenize, then cool and keep it at a temperature between 80 and 90° C. Heat the vacuum residue to homogenize and later keep it to a temperature between 80 and 90° C. to be handled during the process confers it the characteristic to use any type of vacuum residue and it is not limited to certain specifications. At the same time, it is not required diluents for handling because the vacuum residue remains fluid.

III. Add the Water: Pour the water in the vessel where the emulsion will be prepared, heat the water, and keep its temperature between 55 and 60° C., previously the mixer has been placed in the vessel. The impeller of the mixer is positioned at water level, in the center of the vessel.

IV. Add the Surfactant and the Vacuum Residue: Add the surfactant to the water and start mixing at a speed of 200 revolutions per minute (RPM); once it is incorporated in to the water, start adding the vacuum residue previously weighted and heated for handling, at this stage change the mixing speed at 700 RPM. The addition of the vacuum residue is every two minutes for about 20-30 minutes approximately. The amount added every two minutes depends on the incorporation of the vacuum residue in the emulsion. Likewise, the addition of vacuum residue continues until all the vacuum residue in the vessel has been added, keeping the temperature of the vacuum residue between 80 and 90° C.; and the emulsion that is being prepared between 55 to 60° C.

V. Relocate the Mixer: Once the entire vacuum residue was added, turn off the mixer and move the impeller of the mixer, placing it in the emulsion, a third of the height of the emulsion prepared.

VI. Homogenize the Emulsion: Turn on the mixer at 700 RPM for 20 minutes to homogenize the emulsion, take care that the emulsion temperature is between 55 and 60° C. The shear stress imposes to the vacuum residue with the impeller, and the procedure used to add the vacuum residue into the vessel, which contains water and surfactant, together with the temperature and characteristics of the surfactant used produces an emulsion with particle size that does not significantly change with respect to time. Namely, it remains stable, because it does not require additional stabilizers for its preservation. Additionally, the type of surfactant and temperature conditions used during the preparation procedure confer to the process the characteristic to use distilled water, tap water or saltwater (seawater) and low concentration of surfactant.

VII. Turn Off the Mixer: After 20 minutes of homogenization, turn off the mixer, let cool the emulsion and weigh the container with the emulsion in it. Then hand over the emulsion prepared into a storage container and close.

VIII. Weigh the Containers: Weigh the containers used for handling the vacuum residue, water, surfactant and the mixing vessel used to prepare the emulsion, to determine the weight of each of the components that remains adhered to them, and determine the final amount of each component in the prepared emulsion. With this process, the emulsified fuel is prepared in batches, and have proportions from 70 to 90% by weight of refining residues, 10 to 30% by weight of water and from 0.1 to 1% by weight of surfactant.

Next, in the following 4 examples will become clear the characteristics of emulsions obtained with the process for preparing emulsions of the present invention using different surfactant concentrations, types of water (distilled, tap water and saltwater) and oil phase (vacuum residue) concentration.

EXAMPLE 1

Emulsions Prepared with Different Surfactant Concentrations

According to the process for preparing emulsion fuels of the present invention, three emulsions of vacuum residue in water where obtained, with a non-ionic surfactant, and without the use of stabilizers or diluents for their preparation. The final proportions of the three emulsions are shown in Table 1. The surfactant concentration was varied from 0.24 to 1%.

The droplet size of the emulsions was higher as the concentration of surfactant was reduced; on the other hand, the measurement made by laser diffraction of these emulsions showed values of mean diameter (D50) of 8.8, 9.5 and 23.2 microns respectively.

TABLE 1

| Component | Emulsion 1 wt % | Emulsion 2 wt % | Emulsion 3 wt % |
|---|---|---|---|
| Vacuum residue | 72.50 | 72.00 | 71.00 |
| Distilled water | 26.50 | 27.50 | 28.76 |
| Surfactant | 1.00 | 0.50 | 0.24 |
| Total | 100.00 | 100.00 | 100.00 |

EXAMPLE 2

Emulsions Prepared with Different Types of Water

According to the process for preparing emulsion fuels of the present invention, three emulsions of vacuum residue in water where obtained, with a non-ionic surfactant, and without the use of stabilizers or diluents for their preparation; using three different types of water: distilled, tap water and saltwater (seawater). The final proportions of the three emulsions are shown in Table 2.

The droplet size of emulsions measurement by laser diffraction, showed values of mean diameter (D50) of 8.8, 8.6 and 10.0 microns respectively.

TABLE 2

| | Type of water used | | |
|---|---|---|---|
| Component | Distilled wt % | Network wt % | Saltwater wt % |
| Vacuum residue | 72.50 | 73.50 | 73.50 |
| Water | 26.50 | 25.50 | 25.50 |
| Surfactant | 1.00 | 1.00 | 1.00 |
| Total | 100.00 | 100.00 | 100.00 |

EXAMPLE 3

Emulsions Prepared with High Concentration of Oily Phase

According to the process for preparing emulsion fuels of the present invention, two emulsions of vacuum residue in water (tap water and distilled water) where obtained, with a non-ionic surfactant, and without the use of stabilizers or diluents for their preparation; using high concentration of oily phase, namely, vacuum residue. The final proportions of the three emulsions are shown in Table 3.

The droplet size of emulsions, measurement by laser diffraction, showed values of mean diameter (D50) of 10.1 and 10.6 microns respectively.

TABLE 3

| Component | Emulsion 1 (tap water) wt % | Emulsion 2 (Distilled water) wt % |
|---|---|---|
| Vacuum residue | 79.00 | 78.00 |
| Water | 20.10 | 21.00 |
| Surfactant | 0.90 | 1.00 |
| Total | 100.00 | 100.00 |

EXAMPLE 4

Stability of the Emulsions

According to the process for preparing emulsion fuels of the present invention, two emulsions of vacuum residue in distilled and tap water where obtained, with a non-ionic surfactant, and without the use of stabilizers or diluents for their preparation. Emulsions that were assessed about their temporal stability, namely the droplet size of the emulsions was measured periodically to determine its change against the time. The final proportions of the emulsions are shown in Table 4. The droplet size of the emulsions was determined by laser diffraction, and the values of mean diameter (D50) of the emulsion prepared with distilled water were 8 microns when it was prepared and 9 micron 6 months later. To the emulsion prepared with tap water, the values of the mean diameter (D50) were 8.2 and 9.2 microns, the day of his preparation and 6 months later respectively. From the results it can be seen that no significant change in the droplet size of the emulsions occurred, that is, they remained stable.

TABLE 4

| Component | Emulsion 1 (Distilled water) wt % | Emulsion 1 (tap water) wt % |
|---|---|---|
| Vacuum residue | 73.00 | 73.50 |
| Water | 26.00 | 25.50 |
| Surfactant | 1.00 | 1.00 |
| Total | 100.00 | 100.00 |

Once the invention have been described, it is considered novelty and therefore claimed as property the content in the following claims:

1. A method for preparing fuel-in-water emulsions from oil refining residues in a continuous process, the method comprising:

(a) providing a vacuum residue, optionally from a vacuum distillation tower;

(b) passing the vacuum residue to a heat exchanger;

(c) adjusting the vacuum residue to a temperature of approximately 110° C. with the heat exchanger;

(d) passing the vacuum residue from the heat exchanger to a storage container, and maintaining the temperature of the vacuum residue in the storage container at approximately 110° C.;

(e) passing the vacuum residue from the storage container to a static mixer;

(f) passing a homogenized mixture of a non-ionic surfactant and water from a container to the static mixer at a temperature between 55 and 60° C.;

(g) mixing the vacuum residue with the surfactant-water mixture in the static mixer at a temperature between 70 and 110° C. to form a preliminary mixture;

(h) passing the preliminary mixture to a dynamic mixer;

(i) mixing the preliminary mixture at a temperature between 60 and 80° C. in the dynamic mixer to form a completed emulsion;

(j) optionally passing the completed emulsion from the dynamic mixer to an emulsion storage container;

wherein the completed emulsion has from 70 to 90 percent by weight refining residues, from 10 to 30 percent by weight water, and from 0.1 to 1 percent by weight surfactant, the total percent of the refining residues, water, and surfactant being 100%.

2. The method of claim 1, wherein the method does not use a chemical stabilizer for preservation of the completed emulsion.

3. The method of claim 1, wherein the method does not use a diluent.

4. The method of claim 1, wherein the water is distilled water, tap water, salt water, or a combination thereof.

5. A method for preparing fuel-in-water emulsions from oil refining residues in a batch process, the method comprising:

(a) weighing a vacuum residue, a non-ionic surfactant, and water separately and adding each component to a separate container;

(b) heating the vacuum residue at approximately 110° C.;

(c) after heating in step (b), cooling the vacuum residue to a temperature between 80 and 90° C.;

(d) providing a mixer having an impeller in an emulsion preparation vessel;

(e) adding the water to the emulsion preparation vessel such that the impeller of the mixer is positioned at water level in the center of the emulsion preparation vessel;

(f) maintaining the water in the emulsion preparation vessel at a temperature between 55 and 60° C.;

(g) adding the non-ionic surfactant to the water in the emulsion preparation vessel to form a surfactant-water mixture;

(h) mixing the surfactant-water mixture at a speed of 200 RPM;

(i) after the non-ionic surfactant is incorporated into the water in the emulsion preparation vessel, adding the vacuum residue to the emulsion preparation vessel to form a preliminary mixture, keeping the vacuum residue at a temperature between 80 and 90° C., and keeping the preliminary mixture at a temperature between 55 to 60° C.;

(j) during the addition of the vacuum residue in step (i), mixing the preliminary mixture at a speed of 700 RPM, to form an emulsion;

(k) after all the vacuum residue is added to the emulsion preparation vessel, stopping the mixing and moving the impeller of the mixer to a height of one-third of the height of the emulsion;

(l) mixing the emulsion at 700 RPM at a temperature between 55 and 60° C. to form a homogenized emulsion;

(m) cooling the homogenized emulsion to form a completed emulsion;

wherein the completed emulsion has from 70 to 90 percent by weight refining residues, from 10 to 30 percent by weight water, and from 0.1 to 1 percent by weight surfactant, the total percent of the refining residues, water, and surfactant being 100%.

6. The method of claim 5, wherein step (i) comprises adding the vacuum residue every 2 minutes for approximately 20 to 30 minutes.

7. The method of claim 5, wherein in step (1), the preliminary mixture is mixed for 20 minutes.

8. The method of claim 5, wherein the method does not use a chemical stabilizer for preservation of the finished emulsion.

9. The method of claim 5, wherein the method does not use a diluent.

10. The method of claim 5, wherein the vacuum residue remains fluid at least after being heated in step (b) and up to being mixed in the emulsion preparation vessel in step (i).

11. The method of claim 5, wherein the water is distilled water, tap water, salt water, or a combination thereof.

* * * * *